United States Patent [19]

Bandell

[11] 4,194,617

[45] Mar. 25, 1980

[54] NAIL POLISH KIT

[75] Inventor: Ira Bandell, Cranford, N.J.

[73] Assignee: Cosmetic Arts, Inc., Clark, N.J.

[21] Appl. No.: 575,986

[22] Filed: May 8, 1975

[51] Int. Cl.[2] ..... B65D 5/50; B65D 5/48

[52] U.S. Cl. ..... 206/45; 206/45.14; 206/45.19; 211/72; 229/29 F

[58] Field of Search ..... 206/45, 45.11, 45.14, 206/45.19, 45.15; 229/29 F, 28 R, 28 BC; 211/72; 248/152

[56] References Cited

U.S. PATENT DOCUMENTS

| | | | |
|---|---|---|---|
| 2,000,870 | 5/1935 | Ziemmerman | 206/45.14 |
| 2,021,003 | 11/1935 | Einson et al. | 206/45 |
| 2,096,315 | 10/1937 | Bemiss | 229/28 R |
| 2,219,597 | 10/1940 | Lutz | 206/45.14 |
| 2,278,914 | 4/1942 | Cowles | 206/44.11 |
| 2,421,850 | 6/1947 | Ringler | 229/28 BC |
| 2,654,469 | 10/1953 | Fulmer et al. | 206/45.11 |
| 2,725,978 | 12/1955 | Calabrese | 206/45 |
| 2,828,047 | 3/1958 | Weiselberg | 229/29 F |
| 2,914,184 | 11/1959 | Dgetluck | 211/72 |

*Primary Examiner*—William T. Dixson, Jr.

*Attorney, Agent, or Firm*—Martin P. Hoffman; Mitchell B. Wasson; Geoffrey L. Chase

[57] ABSTRACT

A nail polish kit comprising an outer carton, an inner display box, a unique tray that is inserted into the display box, and a retainer with cut-out slots. Vertically upstanding central wall divides tray into front and rear sections, both sections being rectangular in end elevation. Fro section includes plurality of wells that are temporarily covered by pairs of pivotable flaps, and each well receives small bottle of nail dress therewithin. Rear section includes plurality of actuators composed of strut and seat; when actuator is depressed, seat assumes horizontal position, and a large bottle of nail dress is seated thereupon. Upper extremities of caps for small and large bottles of nail dress terminate in same horizontal plane, and retainer is slipped over caps to minimize contact between adjacent bottles of nail dress.

Tray is erected from unitary blank by minimum number of simple operations including gluing flaps to predetermined panels, applying manual pressure to opposite ends of glued blank to elevate central wall, and applying manual pressure to actuators to cause same to function in toggle-like manner and snap seats into locked position and retain tray in fully erected condition.

4 Claims, 8 Drawing Figures

NAIL POLISH KIT

BACKGROUND OF THE INVENTION

1. Field of the Invention

The invention relates generally to the packaging of different sizes of bottles of nail dress in a kit that is inexpensive to fabricate, yet is visually pleasing. Furthermore, the instant invention relates to an efficient method of rigidly erecting the tray so that the bottles are securely retained therewithin.

2. Background of the Invention

Several attempts have been made to produce a nail polish kit fabricated from components that are (1) compatible with high speed, low cost assembly techniques, and (2) yet restrain the bottles in the kit from sliding into contact with one another as the kit is handled and shipped to its ultimate destination. Obviously, the repeated contact between the glass bottles leads to a significant breakage rate, and the spilled contents of even one bottle will ruin the kit.

The majority, if not all, of the trays presently employed in nail polish kits rely upon upstruck or folded paper tabs that engage each bottle on its sides to retain the bottles in fixed position. However, the tabs must be carefully pivoted into a plane perpendicular to the longitudinal dimension of the tray; the pivoting of several tabs is a tedious and time-consuming chore. Furthermore, the tabs possess but minimal strength, and the weight of the filled bottles may force aside the tabs if the kit is handled roughly, as frequently occurs during shipping, and the adjacent bottles then slide vigorously against each other.

The relatively high labor costs of assembling known nail polish kit and filling same with several bottles of nail dress products, in addition to the high rate of bottle breakage and kit destruction attributable to the shortcomings of conventionally used trays, has generated considerable interest in designing an improved tray. To date, however, a commercially acceptable tray solving the aforementioned problems has not been forthcoming.

SUMMARY

Thus, with the deficiencies of known nail polish kits clearly in mind, the instant invention contemplates a unique tray configuration that securely retains the various nail dress bottles in fixed position. Additionally, the instant invention contemplates an innovative blank for the tray that can be die cut, stamped, scored and glued by known paperboard processing machines, and can subsequently be erected at high production rates with a few simple manual operations at the situs of the filling machines of the nail dress manufacturer. Furthermore, the instant invention contemplates an assembled kit that is visually pleasing and wherein the bottles of different heights are retained within the tray in such a fashion that the caps of the bottles define a horizontal plane; consequently, several kits can be stacked upon one another.

Yet other advantages attributable to the instant invention will become readily apparent to the skilled artisan when the accompanying drawings are construed in harmony with the ensuing specification.

DESCRIPTION OF THE PREFERRED EMBODIMENT

Figure 1:
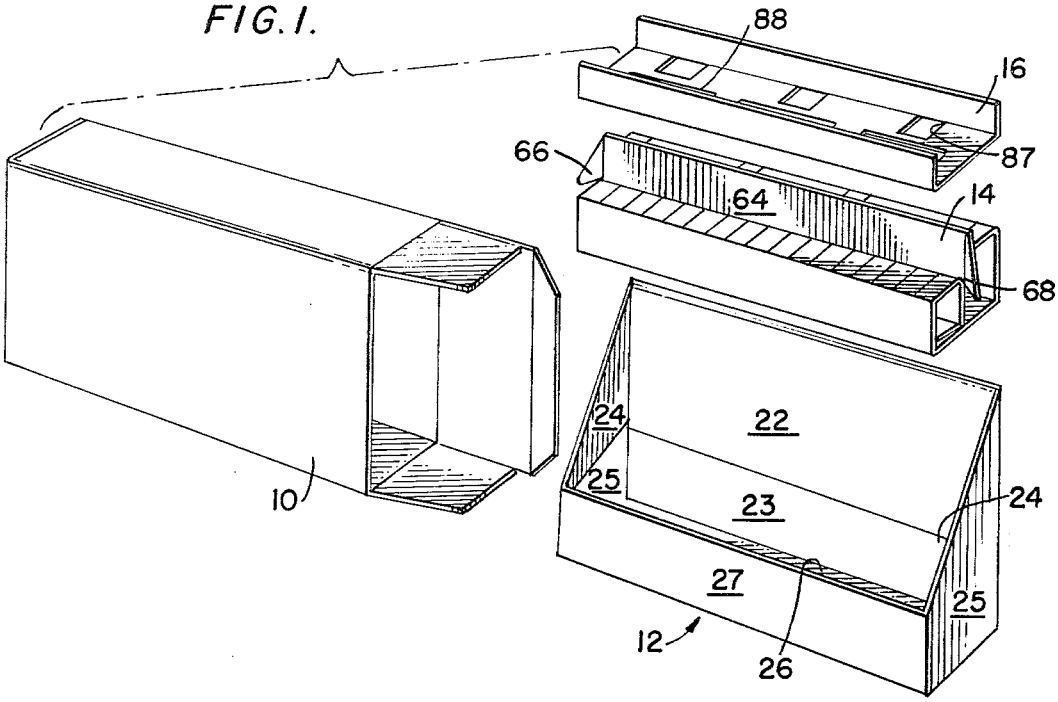
FIG. 1 is an exploded perspective view of the components nail polish kit prior to inserting the bottles of nail dress.

Referring now to the drawings which depict a nail polish kit employing a unique tray constructed in accordance with the principles of this invention, FIG. 1 illustrates an outer carton 10, a display box 12, a tray 14 and a retainer 16 that comprise the major components of the kit. Carton 10, display box 12 and retainer 16 are of conventional design. Box 12 is slightly smaller than carton 10, and fits snugly therewithin. Carton 10 and box 12 have a glossy, colored exterior surface and shiny, white interior surfaces.

The interior of display box 12 includes a rear flap 22 which overlaps about two-thirds of the rear wall 23, and a pair of triangular side flaps 24 which overlap the spaced side walls 25 of the box 12. An upwardly opening chamber 26, which is U-shaped when viewed in side elevation, is defined at the lower end of the box 12 by the pair of spaced side walls 25, the rear wall 23 and the front wall 27. It should be noted that the inner wall of the box 12 below flaps 22 and 24 is untreated paperboard and contrasts with the glossy, colored flaps 22, 24.

Figure 2:
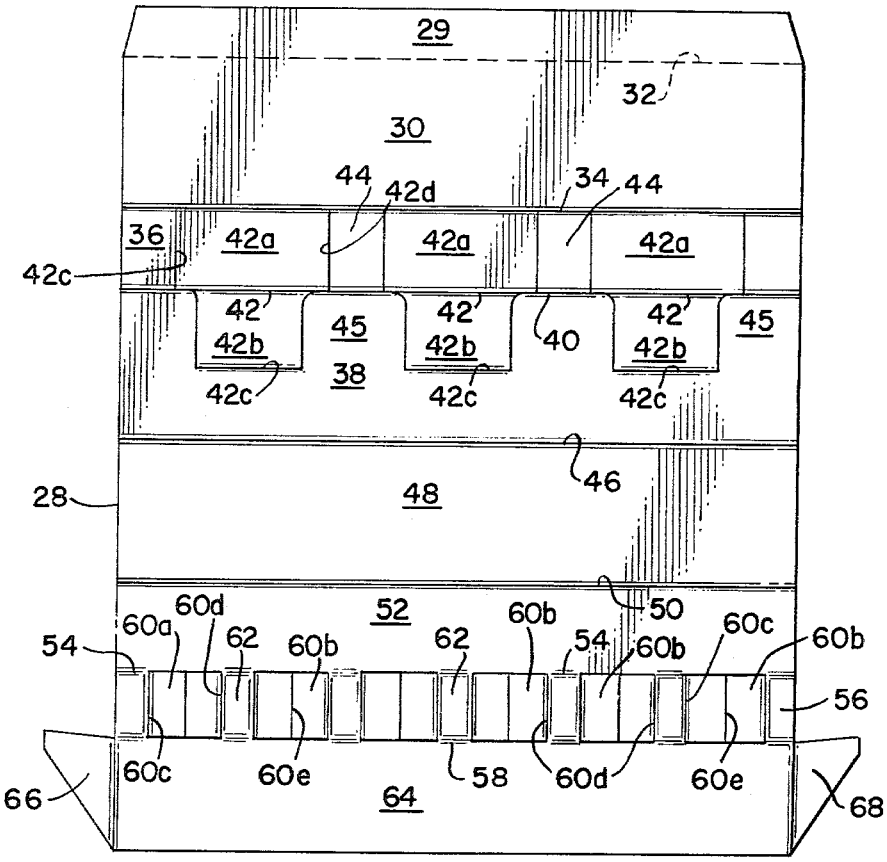
FIG. 2 is a top plan view of the integral blank for the tray of the nail polish kit.

The tray 14 is erected from a specially designed blank 28, which is best shown in FIG. 2 with its glossy, colored side facing the viewer. The blank comprises a glue flap 29 that is separated from first central wall panel 30 by a scored line 32, and another scored line 34 separates the lower edge of panel 30 from a smaller panel 36, which is designated as the first horizontal panel. The panel 30, in turn, is separated from rear panel 38 which is substantially the same size as panel 30, by scored line 40. The terms central wall, horizontal panel, rear panel, and the like refer to the ultimate assembled disposition of the various panels.

A plurality of continuous, generally T-shaped actuators 42 are defined in adjacent panels 36 and 38. Each actuator 42 is a continuous entity divided by scored line 40 into a strut 42*a* and a seat 42*b*; the significance of these actuators will become more readily apparent at a later juncture in the specification. Strut 42*a* is joined to the blank along scored line 34, which will function as a hinge, but is die-cut free from the blank 28 along opposed edges 42*c* and 42*d* which extend along panels 36 and 38. A plurality of rectangular webs 44 separate the struts 42*a* from one another, while a plurality of inverted U-shaped webs 45 separate the seats 42*b* from one another.

The strut 42*a* for each actuator 42 is substantially rectangular in shape, and somewhat larger in size than the substantially rectangular seat 42*b*. Each strut 42*a* is die-cut free from the blank 28 along opposed lateral edges 42*c* and 42*d*, while each seat 42*b*, however, is anchored to the blank 28 along hinge line 42*e*, which is an unscored line parallel to the scored lines 32, 34 and 40. The hinge line 42*e* is spaced at about the center of rear panel 38.

Another scored line 46 demarcates the lower end of rear panel 38, and separates panel 38 from unbroken bottom panel 48. Another score line 50 separates bottom panel 48 from a smaller front panel 52, which, in turn, is defined at its lower end by scored line 54. A second horizontal panel 56 is bounded by scored lines 54 and 58.

A plurality of pairs of flaps 60*a*, 60*b* are formed in panel 56. Each flap is die-cut free from the blank 28 along three of its sides; flaps 60*a* are anchored to the blank along hinge line 60*c*, while flaps 60*b* are anchored to the blank along hinge line 60*d*. The flaps are separated from each other along die-cut central line 60*e*, which is perpendicular to, and extends between, the scored lines 50 and 54. Each pair of flaps 60*a*, 60*b* is spaced from the adjacent pair of flaps by a web 62.

The configuration of the blank 28 is completed by a second central wall panel 64 defined between scored line 58 and the bottom edge of the blank 28. A first triangular-shaped ear 66 is formed at one edge of the panel, and a second triangular-shaped ear 68 is formed at the opposite edge of the panel. The ears can be bent about scored lines at the opposite lateral edges of panel 64.

Figure 3:
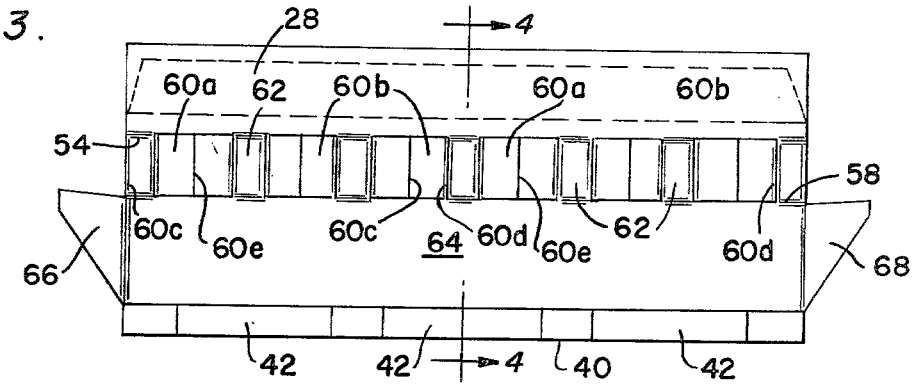
FIG. 3 is a top plan view of the blank of FIG. 2 after the preliminary gluing steps have been completed.
Figure 4:
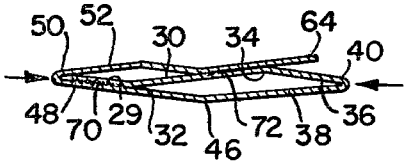
FIG. 4 is a vertical cross-sectional view of the blank, such view being taken along line 4—4 of FIG. 3.

FIGS. 3 and 4 show the completion of some of the preliminary steps for erecting the blank 28 into the tray 14. These steps include the flexing of glue tab 29 and the securement of the untreated surface thereof to the untreated surface of bottom panel 48 a short distance from scored line 50. In order to properly align tab 29 prior to securement, blank 28 is flexed along scored lines 32, 34 and 40. The glue used to join the adjacent surfaces is indicated by reference numeral 70.

Panels 52, 56 and 64 are then flexed about scored lines 50, 54 and 58 so that the unfinished interior surface of the panel 64 overlaps the glossy, colored finished surface of panel 30. Glue is then applied between the overlapping surfaces, as indicated by reference numeral 72. By virtue of the multiple flexing operations along the various scored lines, and the two gluing operations shown at locations 70, 72, the unitary blank 28 is formed into a thin, space-saving, sleeve that can easily be shipped in large quantities from a paperboard processor to the plant of the manufacturer or filler who will insert the filled bottles of nail dress into the trays 14 after completing the erection of the trays.

Figure 5:
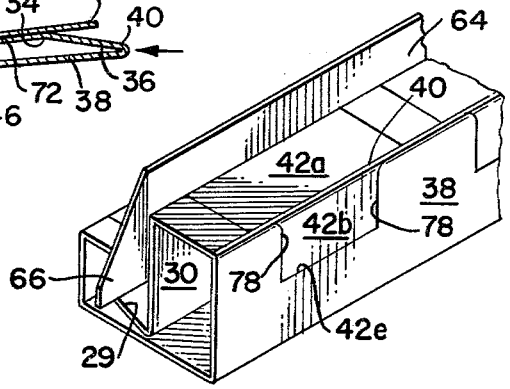
FIGS. 5 and 6 are perspective views of a fragment of the tray showing sequential steps in the process of erecting the tray.

The thin sleeve-like blank shown in FIGS. 3 and 4 is but an intermediate step in the sequence of operation leading from the blank 28 into the fully erected tray 14. The transformation of the sleeve-like blank into the partially erected tray 14 of FIG. 5 is achieved by simultaneously applying manual pressure to the opposite corners of the blank along scored lines 40 and 50. The most advantageous points for applying such pressure are indicated by the directional arrows of FIG. 4, and the pressure is applied until overlapping central wall panels 30 and 64 are pivoted into a vertical plane. Panels 30 and 64 then jointly comprise a vertical, reinforced, central wall which divides the tray 14 into a forward section and a rear section; both sections are open and rectangular when viewed in side elevation, although the rear section is somewhat larger. Ears 66, 68 remain unbent in the plane of panel 64.

Figure 6:
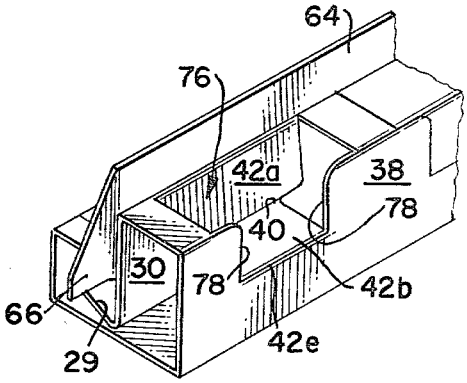

The partially erected tray of FIG. 5 is transformed into the rigid, self-locking tray of FIG. 6 by the simple expedient of manually depressing actuators 42 at, or in proximity to, scored line 40. Each actuator 42, which is anchored at hinge line 42*e*, snaps downwardly at a toggle-like fashion, so that strut 42*a* rests against panel 30 and reinforces same, while seat 42*b* extends horizontally across the rectangular rear section of the tray in a plane parallel to, but spaced from, the floor of the tray. The plurality of actuators 42 can be individually depressed in any sequence, or if the tray is retained in a jig (not shown), all of the members 42 could be depressed simultaneously. The seats 42*b*, when depressed, are rigid and maintain their horizontal orientation, thereby enhancing the structural rigidity of the tray 14 and, in effect, locking same in an erected condition.

The dimensions of each seat 42*b* are slightly smaller than the length and width dimensions of a one-ounce bottle of nail dress, which is commonly used for cuticle oil, polish remover, and cuticle remover, so that a relatively large bottle 74 can be seated thereupon. The dimensions of each strut 42*a* are slightly larger than the dimensions of the midsection of bottle 74, so that the bottle 74 can be received within each individual compartment 76 defined by the depression of member 42 out of the plane of the blank 28. Each bottle 74 is retained in fixed position within compartment 76 by spaced shoulders 78 formed in the web 45 at opposite sides of the opening defined in panel 38.

Figure 7:
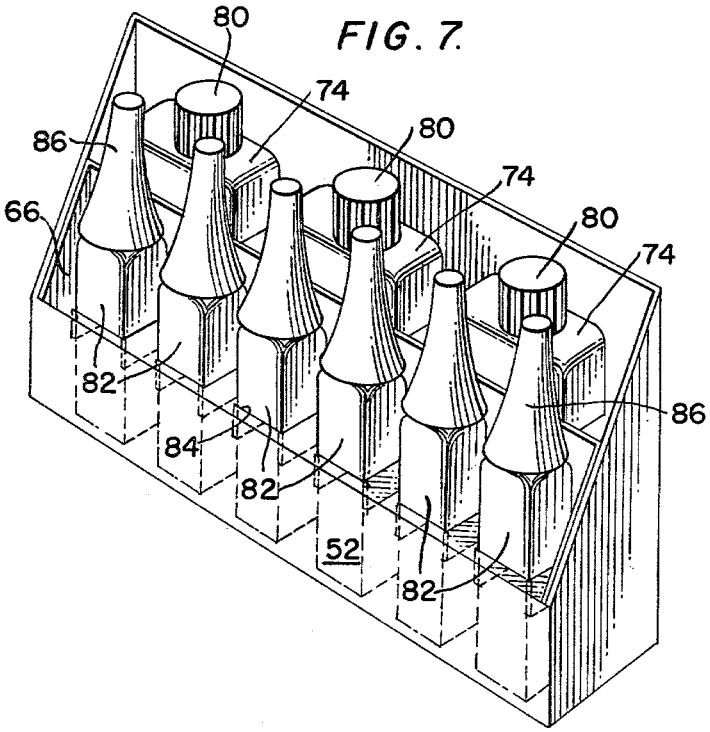
FIG. 7 is a perspective view of the tray filled with bottles of nail dress and seated within the inner display box.

FIG. 7 shows the final steps of the erecting process for the tray 14. A plurality of relatively large bottles 74, which have been filled with different nail dress products, are inserted into compartments 76 and rest firmly upon individual seats 42. The bottles 76 are sealed by screw caps 80. Several small bottles 82, each capable of holding a quarter-ounce of nail polish, are pressed against horizontally disposed flaps 60*a*, 60*b*, and the flaps pivot downwardly about hinge lines 60*c*, 60*d* into a vertical orientation. Each small bottle 82 is then introduced into a well 84 defined within the front section of the tray. Well 84 is rectangular in cross-section and is defined between the front panel 52 and the upstanding central wall 64 of tray 14, and by the distance between hinge lines 60*c*, 60*d*. An elongated screw-cap 86 is seated upon the upper end of each bottle 82.

After the tray 14 has been filled with its full complement of bottles 74, 82, the ears 66, 68 on opposite sides of panel 68 are pivoted through an arc of 90 degrees. The tray 14 is then inserted into the upwardly opening chamber 26 of display box 12, and the ears, which are glossy and colored in the same manner as the flaps 22 and 24 of box 12 and the exterior surfaces thereof, cover the untreated, interior portion of the upwardly opening chamber 26 that would otherwise be visible to the customer. The ears 66, 68 thus contribute to the pleasing visual impression created by the tray 14, as well as by the entire kit.

Figure 8:
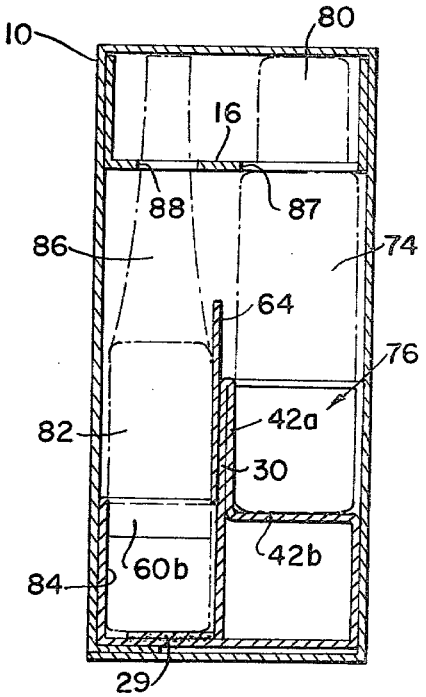
FIG. 8 is a vertical cross-sectional view of the assembled kit.

FIG. 8 reveals the height of seats 42*b*, upon which bottles 78 are seated, relative to glue flap 29 and the bottom panel 48 of the tray 14, upon which bottles 82 are seated. The upper extremities of caps 80 and 86 are parallel to provide a support surface beneath the top panel of outer carton 10. Consequently, several kits filled with bottles of nail dress can be stacked upon each other without damage.

The retainer 16, as previously shown in FIG. 1, is U-shaped when viewed in end elevation and has rectangular cut-outs 87 and narrow longitudinal cut-outs 88 removed therefrom. Cut-outs 87 are spaced so that each cut-out can be slipped over a bottle cap 80, while cut-outs 88 are spaced so that each cut-out can be slipped over a pair of adjacent bottle caps 86. The sidewalls of the retainer 16 fit within carton 10, and the retainer assists in spacing the bottles 74, 82 a fixed distance away from one another.

A plastic overwrap may be wrapped about carton 10 after the kit has been completely assembled, if so desired.

It is readily apparent from the foregoing exemplary description that the principles of the instant invention could easily be applied to the erection and/or assembly of diverse types of kits employing a multitude of products. Similarly, it is readily apparent that the method of erecting the tray, and the exact number and sequence of steps involved therein, could be altered without departing from the inventive thrust of the foregoing description. Consequently, the appended claims should be liberally construed in a manner consistent with the breadth of the instant invention and should not be narrowly limited to the literal terminology of the claims.

I claim:

1. A unitary, integrally formed tray for a nail polish kit comprising:

(a) a front panel, a parallel rear panel, and a bottom panel joining same, (b) a central wall disposed between said front and rear panels and parallel thereto, (c) a first horizontally extending panel joining said front panel to said central wall, (d) a second horizontally extending panel joining said rear panel to said central wall, (e) a plurality of flaps defined in said first horizontally extending panel and temporarily covering a plurality of wells defined therebelow between said bottom panel, and first horizontally extending panel, and said central wall and said front panel.

(f) a plurality of integrally formed actuators defined in said second horizontally extending panel and said rear panel, (g) each of said actuators including a strut that is freed along its lateral edges from the second horizontally extending panel and a seat that is freed along its lateral edges from said rear panel, (h) each actuator, when depressed in the vicinity of the corner defined between said second horizontally extending panel and said rear panel, flexing inwardly in a toggle-like fashion so that said strut reinforces said central wall and said seat is positioned in a horizontal plane spaced above, and parallel to, the bottom panel of the tray, and (i) the seats defined in said rear panel being larger than the wells defined beneath said first panel, each seat being adapted to receive a large bottle of nail dress while each well is adapted to receive a small bottle of nail polish, and (j) the elevation of each seat above said bottom panel of the tray being equal to the difference in the respective heights of the nail polish and nail dress bottles whereby the upper ends of all of the bottles reside in the same horizontal plane spaced above the upper edge of the erected central wall after insertion into the respective wells and seats of the tray.

2. The tray as defined in claim 1 wherein each of said actuators comprises a strut and a smaller seat, one edge of said strut being joined to each second panel at the corner defined between said second panel and said upstanding central wall.

3. The tray as defined in claim 1 wherein each of said seats is joined to said rear panel along a line extending horizontally across said rear panel about midway along the height of said rear panel.

4. The tray as defined in claim 1 wherein a rectangular web is situated between adjacent struts, and an inverted U-shaped web is situated between adjacent seats, the depression of each actuator creating a compartment that is delimited by opposing shoulders on said U-shaped web.

* * * * *